US007374065B2

(12) United States Patent
Taylor et al.

(10) Patent No.: US 7,374,065 B2
(45) Date of Patent: May 20, 2008

(54) FOLDED SHEET DISPENSER HAVING AN OVERFILL PREVENTION MECHANISM

(75) Inventors: Antwain D. Taylor, Suwanee, GA (US); Stephen L. Phelps, Lilburn, GA (US); Debra N. Welchel, Woodstock, GA (US); Victoria L. Bischoff, Roswell, GA (US); Robert C. Ziegenfuss, Stone Mountain, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 792 days.

(21) Appl. No.: 10/283,691

(22) Filed: Oct. 30, 2002

(65) Prior Publication Data

US 2004/0084470 A1 May 6, 2004

(51) Int. Cl.
*B65H 1/00* (2006.01)
*A47K 10/24* (2006.01)

(52) U.S. Cl. ..... 221/45; 221/46; 221/57; 221/279

(58) Field of Classification Search ..... 221/45, 221/46, 57, 279
See application file for complete search history.

(56) References Cited

U.S. PATENT DOCUMENTS

| | | | |
|---|---|---|---|
| 1,944,431 | A | 1/1934 | Hope et al. |
| 2,027,674 | A | 1/1936 | Broeren |
| 2,426,787 | A | 9/1947 | O'Neil |
| 3,341,067 | A | 9/1967 | Bastian |
| 3,589,555 | A | 6/1971 | Burkhalter, Jr. |
| 3,935,965 | A | 2/1976 | Stevens |

(Continued)

FOREIGN PATENT DOCUMENTS

| | | | |
|---|---|---|---|
| EP | 0061589 | A2 | 10/1982 |

(Continued)

OTHER PUBLICATIONS

U.S. Appl. No. 10/283,493, filed Oct. 30, 2002.

*Primary Examiner*—Patrick Mackey
*Assistant Examiner*—Michael Butler
(74) *Attorney, Agent, or Firm*—Dority & Manning, P.A.

(57) ABSTRACT

A dispenser is provided for dispensing stacked folded sheets. The dispenser includes a housing configured to hold the stack of sheets within an internal storage space. A cover member is pivotally attached to the housing and is movable between an open position wherein access is provided to the storage space, and a closed position wherein the cover defines a front panel of the dispenser. A dispensing opening is provided through which the folded sheets are dispensed when the cover is in its closed position. An overfill prevention device is configured within the housing. This device includes a stop member that is movably configured with a back wall of the housing and is movable between a restricting position when the cover is in its open position, and a relief position when the cover is closed. A latch mechanism is disposed in the housing in a position so as latch the stop member in its restricting position when the cover is in the open position. An actuator is disposed on the cover at a location so as to engage and release the latch mechanism when the cover is closed. The stop member is then free to move towards its relief position whereby compressive pressure on the stack of folded sheets is relieved.

5 Claims, 7 Drawing Sheets

U.S. PATENT DOCUMENTS

| | | | | |
|---|---|---|---|---|
| 4,469,243 | A | 9/1984 | Ito et al. | |
| 4,838,454 | A | 6/1989 | Salzmann et al. | |
| 4,938,382 | A * | 7/1990 | Frazier et al. | 221/45 |
| 5,076,466 | A | 12/1991 | Petterson et al. | |
| 5,716,691 | A | 2/1998 | Chan | |
| 5,884,805 | A * | 3/1999 | Tramontina | 221/45 |
| 6,502,372 | B1 * | 1/2003 | Kaneko et al. | 53/476 |
| 2002/0074340 | A1 | 6/2002 | Phelps | |

FOREIGN PATENT DOCUMENTS

| | | | |
|---|---|---|---|
| EP | 0506243 | A1 | 9/1992 |
| WO | 9709918 | A | 3/1997 |
| WO | 9840002 | | 9/1998 |

* cited by examiner

FOLDED SHEET DISPENSER HAVING AN OVERFILL PREVENTION MECHANISM

TECHNICAL FIELD

The present invention relates to the field of folded sheet dispensers, and more particularly to folded paper product dispensers having an overfill prevention device.

BACKGROUND

Dispensers for dispensing stacked folded sheets of paper towels and the like are well known in the art. Single sheet dispensers are generally desirable because they can be refilled when only partially depleted, as compared to roll product dispensers wherein changing a partially depleted roll may result in significant wasted product. Stacked single sheet dispensers are also desirable because they tend to be simple devices that are not subject to jamming or failure.

A disadvantage of folded stacked sheet dispensers is that they are susceptible to attempts at being overfilled or "stuffed." Overfilling the dispenser can compress the stack of sheets and make it very difficult to remove a sheet from the dispenser. For example, the pressure against the stack may prevent a free tab or end of the sheet from becoming accessible for a user to grasp in order to withdraw the sheet. In an overfilled condition, the stack of sheets may be wedged in the dispenser so firmly that the portion of the sheet grasped by the user simply tears instead of dispensing the sheet. Friction against the dispensing opening may be increased by overfilling the dispenser making dispensing unreliable and problematic.

U.S. Pat. No. 5,884,805 proposes one solution for preventing overfilling of stacked folded sheet dispensers. With the dispenser according to the '805 patent, an overfill bracket is moveably connected to the frame of the dispenser such that an over-capacity of folded sheets in the frame displaces the overfill bracket and prevents the dispenser cover from engaging the frame.

Although the '805 patent provides one solution, it has been found that attempts are still made to overfill dispensers according to the '805 patent by pressing down on the bracket and stack of sheets until the sheets have been compressed enough to allow the cover to latch.

U.S. Pat. No. 4,938,382 discloses a cabinet for dispensing stacked paper sheets having a mechanism in the cabinet for restricting the length of the stack of sheets that can be placed in the cabinet when the cabinet is open. The restricting device is movable to a pressure relieving position when the cabinet is closed.

There is still a need in the art for improvements in stacked folded sheet dispensers for preventing overfill conditions. The present invention relates to such an improved dispenser.

SUMMARY

Objects and advantages of the invention will be set forth in part in the following description, or may be obvious from the description, or may be learned through practice of the invention.

According to aspects of the present invention, a dispenser is provided for dispensing stacked folded sheets of paper products, such as paper towels, tissues, and the like. It should be appreciated that the dispenser is not limited by its overall shape or appearance, and that the present invention may be incorporated into any type or configuration of folded sheet dispenser. For example, in one embodiment, the dispenser may be a single dispensing unit configuration. In an alternate embodiment, the dispenser may be a dual dispenser configuration. The dispenser may include any type of aesthetic cover member, housing member, and the like.

The dispenser includes a housing that is configured to hold a supply of stacked folded sheets within an internal storage space. The housing includes a back wall or panel member and a bottom portion that has at least one dispensing opening defined therein. The housing also includes a cover member attached to the housing so as to be movable between an open position wherein access is provided to the internal storage space for loading the stacked folded sheets, and a closed position wherein the cover defines a front panel of the dispenser. The dispensing opening may be in the bottom portion of the housing, or in the bottom portion of the cover member.

An overfill prevention device is configured with the housing and is actuated by movement of the cover from the closed position to the open position. The overfill prevention device reduces the storage space for folded sheets in the housing when the cover member is moved to the open position. Upon movement of the cover member to its closed position, the overfill prevention device is disengaged and any compressive pressure on the stack of folded sheets is relieved upon closing of the cover.

An embodiment of the overfill prevention device includes a stop member that is movably configured on the back wall of the housing. The stop member is movable between a restricting position when the cover is in its open position, and a relief position above the restricting position when the cover is in its closed position.

A latch mechanism is also configured on the housing at a location so as to latch the stop member in its restricting position when the cover is in the open position.

An actuator, for example a plunger-like member or other similar stationary member, is disposed on the cover in a position so as to engage and release the latch mechanism when the cover is in its closed position. The stop member is then released from the latch mechanism and is free to move towards its relief position. In this manner, pressure in the stack of folded sheets is relieved.

In a particular embodiment of the invention, the stop member may be a relatively simple block member of any desired shape, for example a wedge shape. The block member defines a ledge extending generally transversely from the back wall of the housing. The ledge extends to an extent such that the stack of folded sheets must be placed under the ledge within the internal storage space below the ledge. Thus, in the open position of the cover, the ledge defines the upper boundary of the storage volume for the stack of folded sheets.

The stop member, for example the block member, may be slidably engaged in a longitudinally extending slot defined in the back wall of the housing. The slot has a longitudinal length such that in a lower position of the slot, the stop member is latched in its restricting position, and in an upper portion of the slot, the stop member is at its relief position.

In one embodiment, the latch mechanism is disposed at a position along the slot that defines the restricting position of the stop member. The latch mechanism prevents movement of the stop member within or along the slot until the latch mechanism is released by the cover. For example, the latch mechanism may comprise a head member that may be configured, for example, as a hook-type member, extending generally transversely into the slot so as to engage and inhibit movement of the stop member along the slot. The member is preferably a resilient member and is biased into the slot. The latch is moved out of the slot by engagement with the actuator on the cover member. Once the latch member has cleared the slot, the stop member is free to slide past the latch member to its relief position. As the stack of folded sheets is depleted, the stop member slides down within the slot to a location below the latch mechanism. Upon opening the cover member, the actuator on the cover member disengages from the latch mechanism and the latch automatically moves into the slot so as to restrict movement of the stop member above the restricting position until the cover member is subsequently closed.

In one particular embodiment, the latch member includes the hook-like head member described above and a resilient leg member that is disposed generally along the slot. For example, the leg member may be a portion of a back wall of a channel defining the slot. In another embodiment, the latch mechanism may be any conventional spring or resilient biased device.

It should be appreciated that the overfill prevention device according to the present invention may be utilized in any configuration or style of folded sheet dispenser.

The invention will be described in greater detail below with reference to exemplary embodiments of the invention illustrated in the figures.

DETAILED DESCRIPTION

Figure 1:
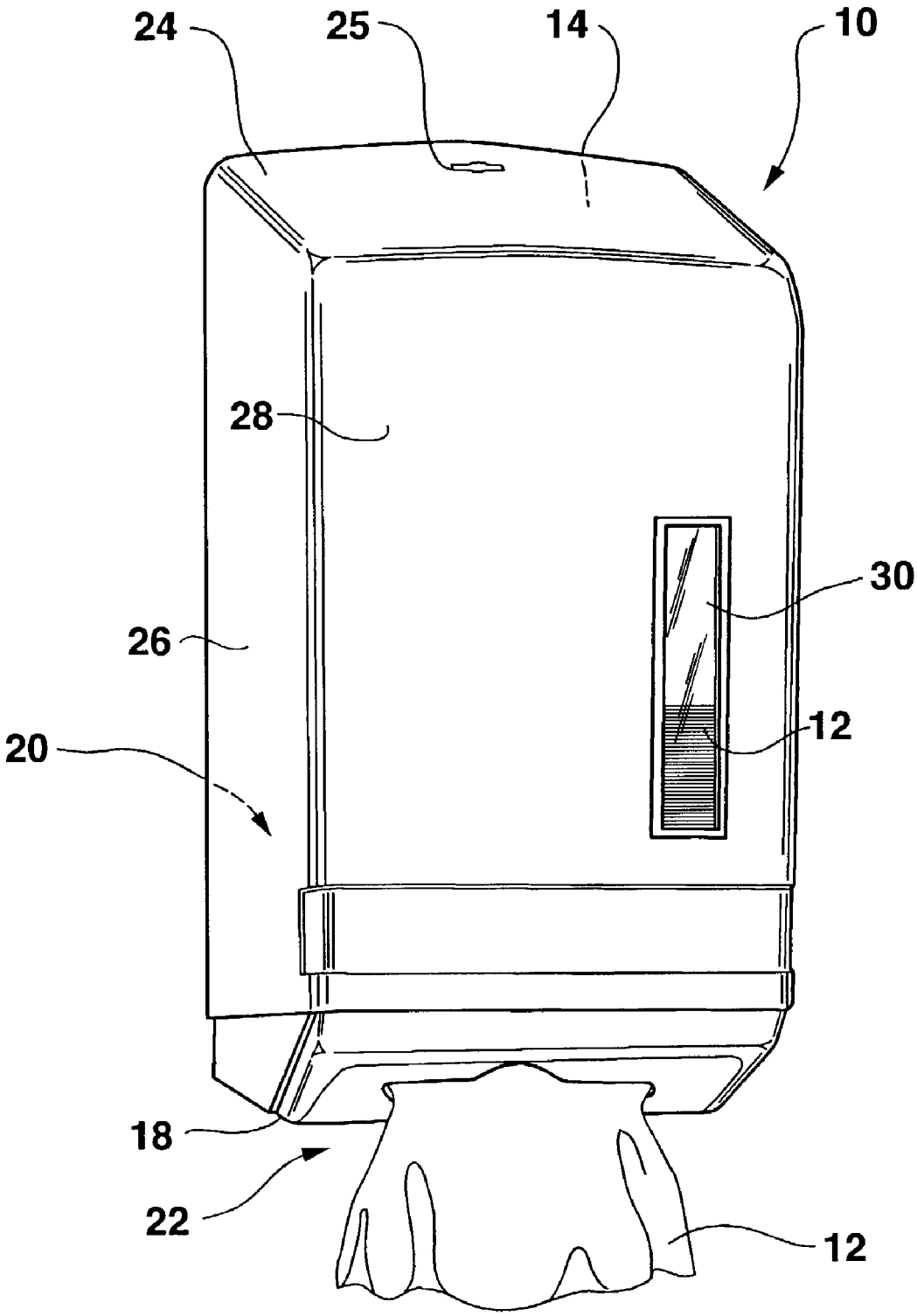
FIG. 1 is a perspective view of a single mode folded sheet dispenser in accordance with the present invention.

Reference will now be made in detail to embodiments of the invention, examples of which are illustrated in the drawings. Each example is provided by way of explanation of the invention, and not as a limitation of the invention. For example, features illustrated or described as part of one embodiment can be used with another embodiment to yield still a further embodiment. It is intended that the present invention include these and other modifications and variations to the embodiments and examples described herein as come within the scope and spirit of the invention.

Referring to the figures in general, a dispenser 10 according to aspects of the invention is illustrated. The dispenser 10 is configured for dispensing stacks of folded individual sheets 12. The dispenser 10 is particularly suited for dispensing paper towels, tissues, and the like. However, it should be appreciated that a dispenser according to the invention is not limited in this regard. The dispenser will be described herein as it relates to a paper towel dispenser for clarity and ease of explanation.

Figure 2:
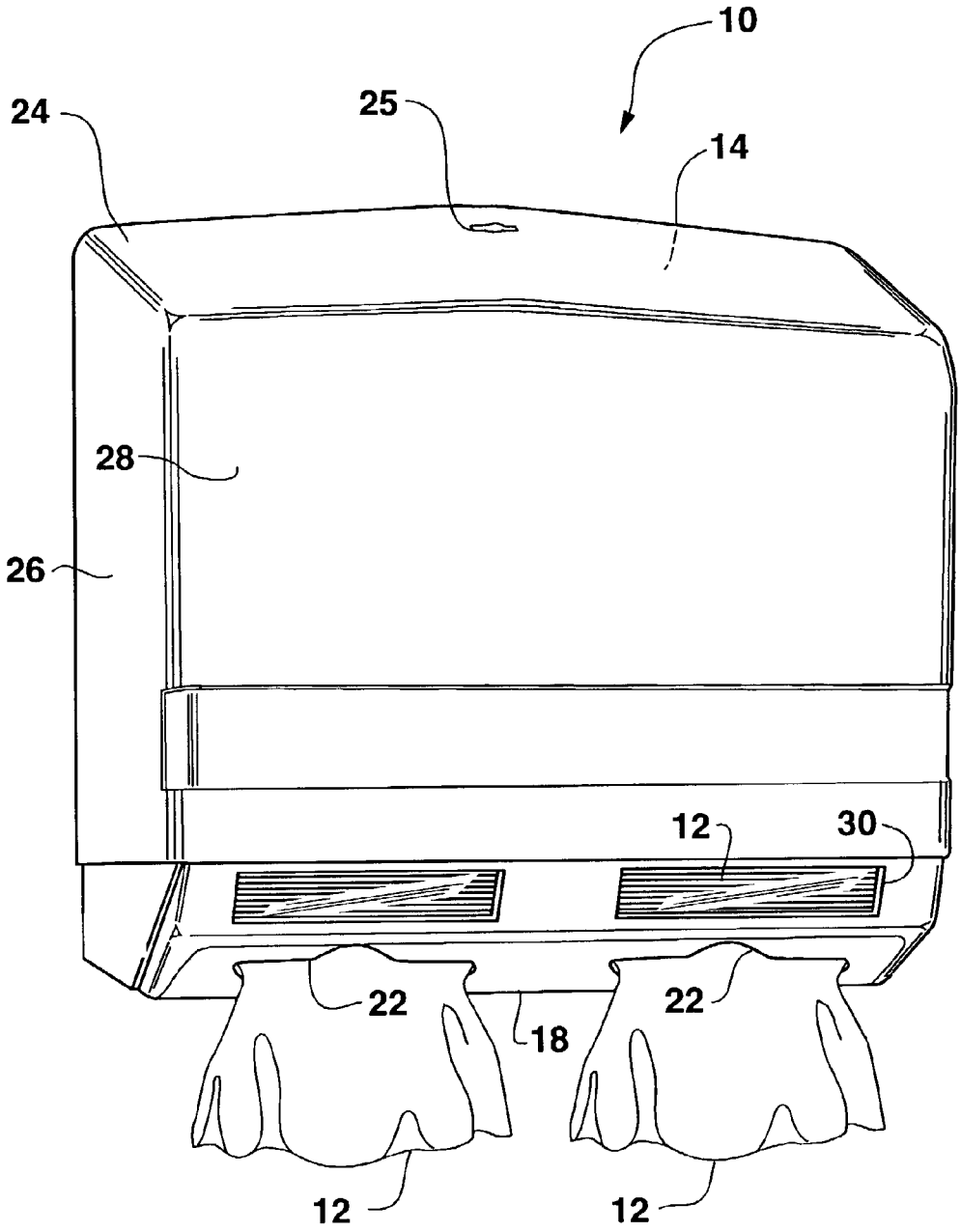
FIG. 2 is a perspective view of a dual mode folded sheet dispenser in accordance with aspects of the present invention.

It should also be appreciated that a dispenser 10 according to the invention is not limited in its overall shape or configuration. For example, the dispenser illustrated in FIG. 1 has the overall shape and configuration of a dispenser provided by Kimberly-Clark Corporation of Neenah, Wis., U.S.A. and identified as an INTERLEAVED BATHROOM TISSUE DISPENSER (Item No. 74406). This particular dispenser is a single mode dispenser in that it dispenses a single stack of folded sheets. The illustrative dispenser 10 of FIG. 2 is configured as a dual mode dispenser for dispensing two stacks of folded sheets. A dispenser of this type is available from Kimberly-Clark Corporation and is identified as the SANI-TOUCH® TWIN INTERLEAVED DISPENSER (Item No. 09012). It should be understood that these particular dispensers are illustrated merely as an example of embodiments of a dispenser that may incorporate the unique features of the present invention.

The dispenser 10 includes a housing 14 that is configured to hold a stacked supply of folded sheets 12 within an internal storage space 20 defined within the housing 14. The housing 14 is typically mounted to a support surface, such as a wall, or the like. The housing 14 may include a back panel or wall 16, side walls 17, a bottom panel or portion 18, and a cover 24. The housing 14 may be formed of any suitable material, including metal, plastic, and so forth. The construction of such dispensers is well known to those skilled in the art and need not be described in great detail herein.

Figure 3:
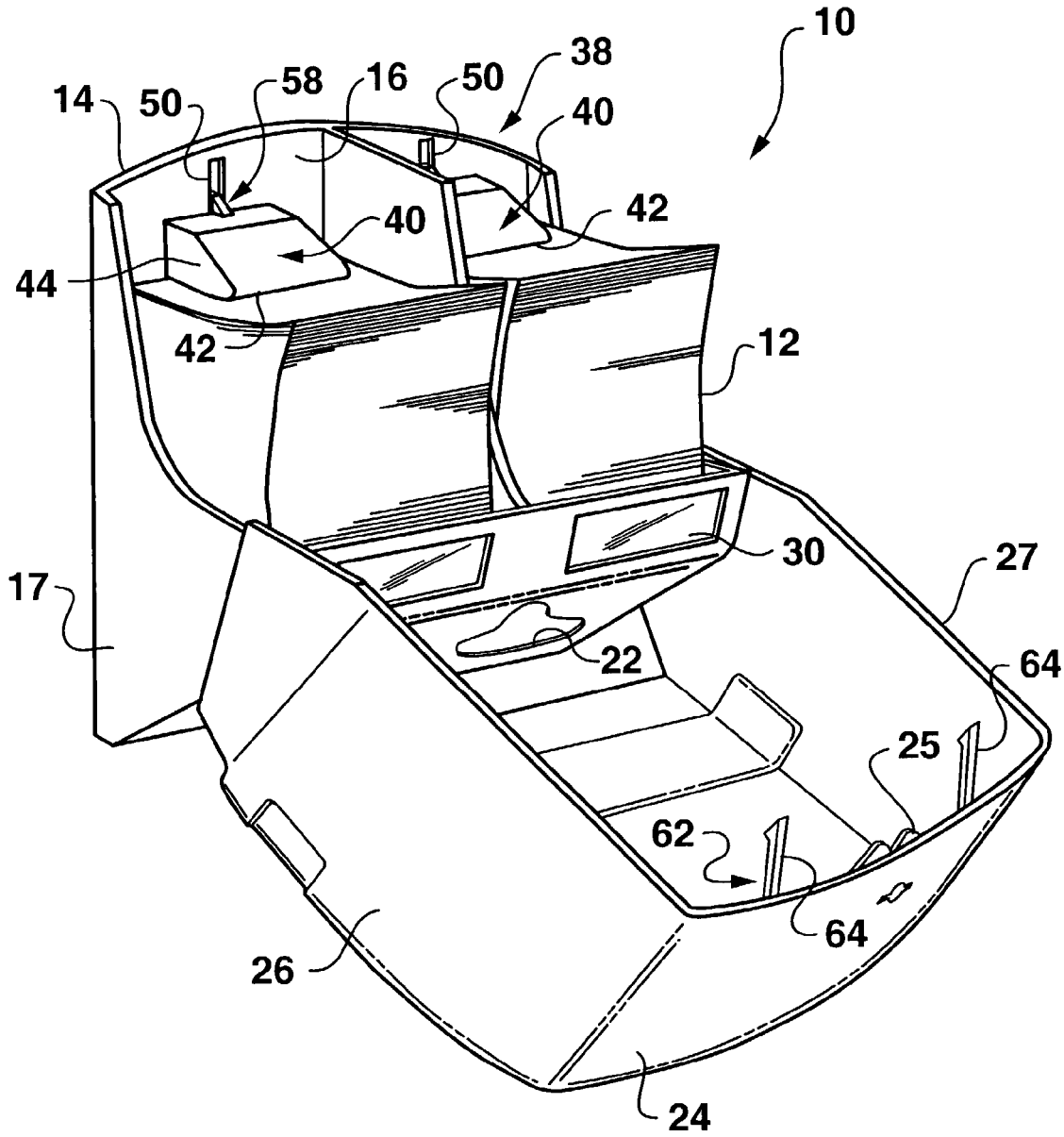
FIG. 3 is a perspective view of the dual mode dispenser shown with the cover member in the open position.
Figure 4:
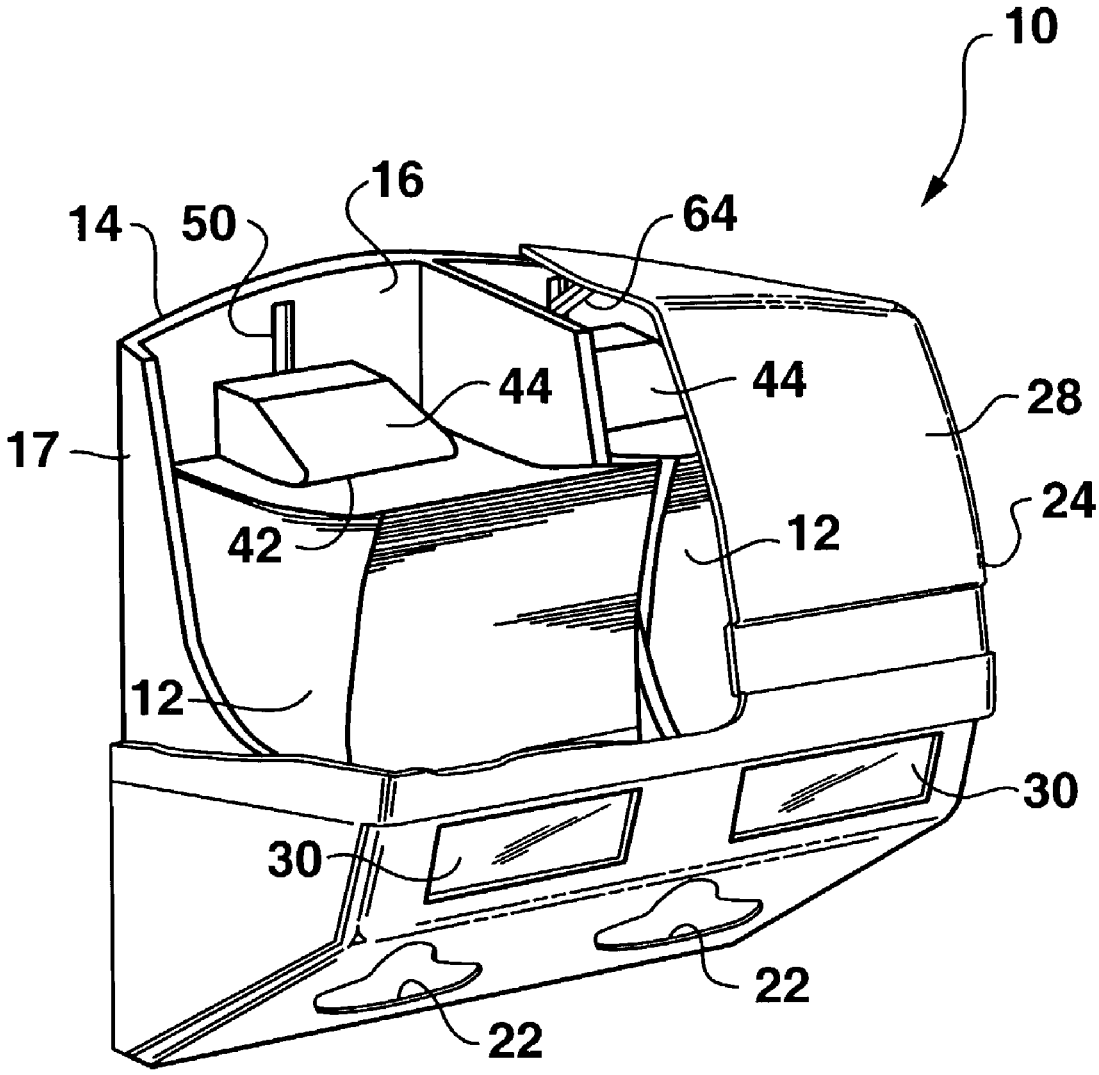
FIG. 4 is a partial cut-away perspective view of the dual mode dispenser shown with the cover in the closed position.
Figure 5:
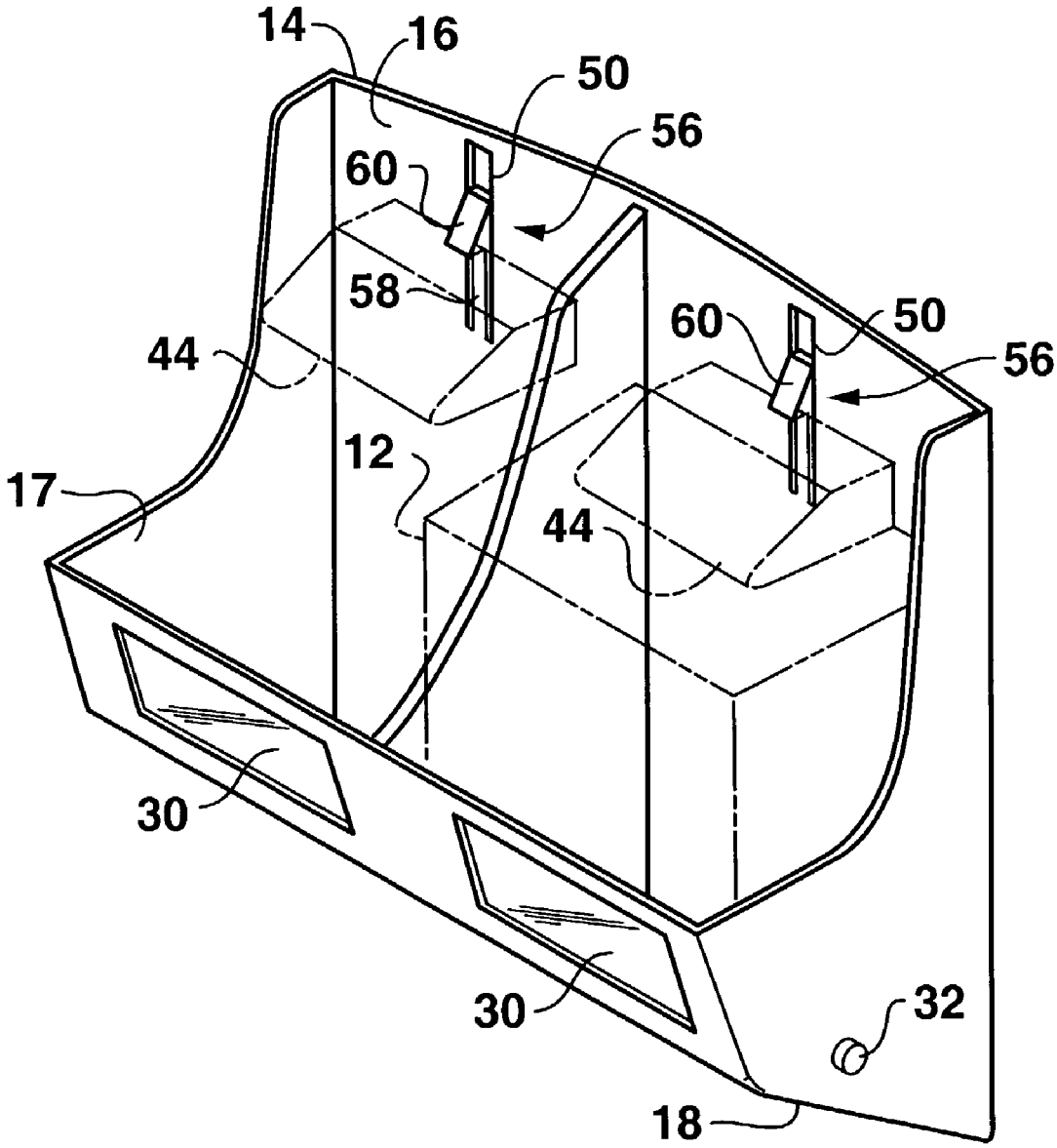
FIG. 5 is a perspective view of the housing member of the dual mode dispenser according to the invention particularly showing the overfill prevention device.
Figure 6:
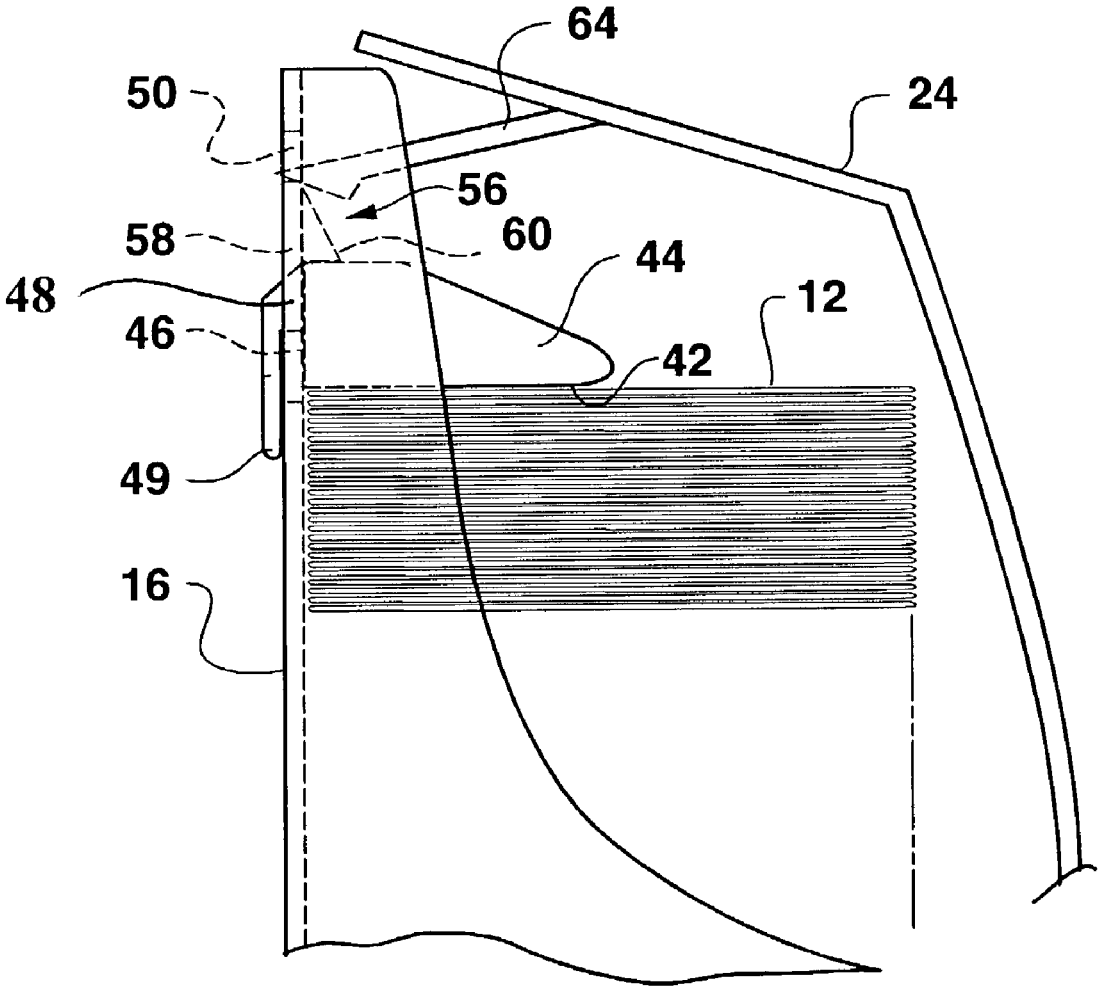
FIG. 6 is a side view illustrating operational concepts of the overfill device according to the invention.

The cover member 24 is attached to the back stationary part of the housing 14, for example to the bottom panel 18 or side walls 17, and is movable from a closed position as illustrated in FIG. 4, to an open position as illustrated in FIG. 3. In the open position, access is provided to the internal storage space 20 for loading additional folded sheets 12. In its closed position, the cover 24 defines a front panel 28 of the dispenser 10. The cover 24 is pivotally mounted to the stationary part of the housing 14 by any conventional pivotal mounting mechanism 32. For example, in the illustrated embodiment, a simple rod or axel member may be provided and retained at location 32. The cover member includes side panels 26 that are rotationally fixed to the rod or axel at location 32. It should be appreciated that any number of conventional pivotal arrangements are known and may be utilized to pivotally mount the cover member 24. The cover 24 is releasably locked to the back panel member 16 by any conventional locking device 25.

The housing 14 includes at least one dispensing opening 22 through which the folded sheets 12 are dispensed from the internal storage space 20. In the illustrated embodiment, the dispensing opening 22 is defined in the bottom panel 18 of the housing. This is not a limitation of the invention. For example, the dispensing opening could also be defined in a bottom portion or panel member of the cover 24. The dispensing opening 22 may be disposed in any convenient location for a user to pull and dispenser the individual folded sheets 12 from the housing 14.

A window 30 of generally translucent or transparent material may be provided in the housing, particularly in the cover member 24, so that a user or maintenance technician can visibly determine the fill condition of the stack of sheets 12 within the housing 14 without opening the front cover 24.

A dispenser 10 according to the invention includes an overfill prevention device, generally 38, configured within the housing 14. The overfill prevention device prevents a service technician from overfilling or stuffing the dispenser with folded sheets 12 to the point where operation of the dispenser is compromised. In a particular embodiment, the overfill prevention device 38 is actuated by movement of the cover 24. With the cover 24 closed, as the stack of sheets 12 is depleted, the overfill prevention device automatically moves to a position below a latch mechanism so as to reduce the internal storage space 20 within the housing 14. When the cover 24 is opened for refilling the stack, the overfill prevention device 38 is engaged and the available space for refilling the stack is restricted. When the cover member 24 is subsequently closed after refilling the supply of stacked sheets 12, the overfill prevention device 38 is disengaged and any compressive forces acting on the stack of sheets is relieved.

Referring particularly to FIGS. 3 through 7, in an embodiment of the overfill prevention device 38, a stop member 40 is movably configured with respect to the back panel or wall 16 of the housing 14. The stop member 40 is movable between a restricting position illustrated in FIG. 3 when the cover is in its open position, and a relief position illustrated in FIG. 4 when the cover 24 is in its closed position.

The stop member 40 may take on any various shape or configuration and, in one embodiment, may be a block member defining a ledge 42 that extends generally transversely into the storage space 20 such that the folded sheets are placed under the ledge 42 within the internal storage space 20. The ledge 42 extends transversely from the back wall 16 of the housing 14. In a particular embodiment, the stop member 40 may comprise a relatively simple block member, such as a wedge. The block member 44 has a back side 46 that is longitudinally slidable along the back wall 16. For example, an engagement tab 48 with longitudinally extending legs 49 extends from the back side 46 of the block 44 may be slidably engaged within a longitudinally extending slot 50 defined in the back wall.

Figure 8:
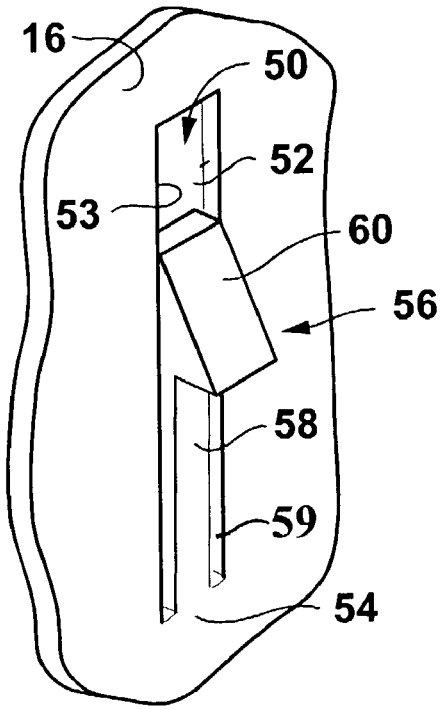
FIG. 8 is a perspective view of the back wall of a dispenser housing unit particularly illustrating the slot and latch mechanism configuration of an embodiment of the invention.

The slot 50 may be defined by various constructions. In the illustrated embodiment, the slot 50 may be defined by a recessed channel 52 defined in the back wall 16. The channel 52 includes side walls 53 and may have an open or closed back. Openings or slots may be defined in the side walls 53 through which laterally extending wings (not shown) of the engagement tab 48 extend to prevent the block 44 from being pulled or removed from the slot 50. If the slot 50 has an open back as illustrated in FIG. 8, wings on the tab 48 may extend laterally across the back side of wall 16. In an alternative embodiment, the channel walls 53 may be curved or angled in an opposite direction from curved or angled sides of the engagement tab 48, similar to a dove-tail configuration, to prevent the block 44 from being pulled or separated from the slot 50.

A latch mechanism, generally 56, is disposed in the housing 14 in a position relative to the slot 50 so as to latch the stop member 40 in the restricting position illustrated in FIG. 3 when the cover 24 is open. The latch mechanism 56 prevents movement of the block 44 within the slot 50 until the latch mechanism 56 is released or disengaged by the cover 24.

Figure 7:
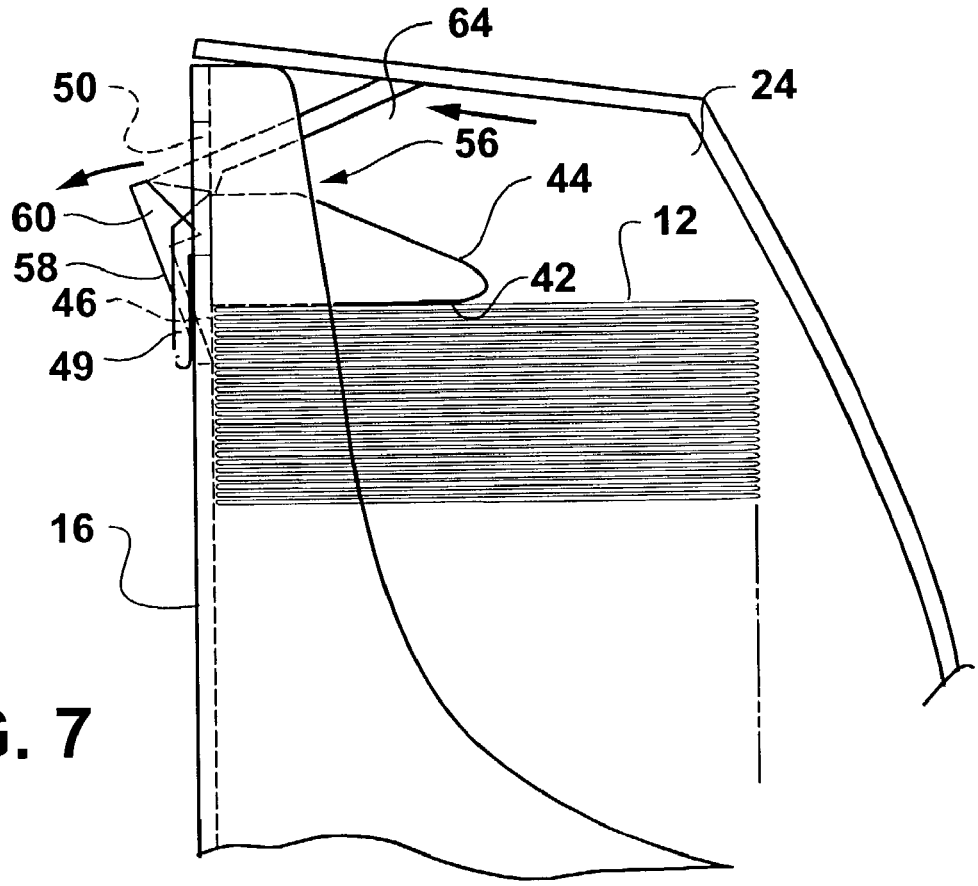
FIG. 7 is a side view illustrating operational principles of the overfill prevention device with the cover member of the dispenser in a closed position.

In the illustrated embodiment, the latch mechanism 56 is a resiliently mounted mechanism that extends generally transversely from the back wall 16 and is biased into the slot 50 to an extent sufficient to block movement of the stop member 40, for example by engaging against the engagement tab 48. The latch may include, for example, a head 60 that extends generally transversely from the back wall and may have, for example, a hook-like configuration. The head 60 is attached or mounted to a resilient leg member 58. For example, referring to FIGS. 6 through 8, the latch mechanism 56 may include the resilient leg 58 disposed within the channel 50. For example, the leg 58 may be coplanar with the back wall 54 of the slot 50. In one embodiment, the resilient leg 58 may comprise a part of the back wall 54 defined by cut lines such that a finger-like resilient member (leg 58) is defined between slits 59. The head 60 may extend transversely from the leg 58 into the slot 50 so as to engage against the engagement tab 48 of the stop member 40. The longitudinally extending legs 49 of the block member tab 48 slide longitudinally along the slits 59 and against the back side of the wall 16 when the block 44 is in its lowermost position of the slot 50. The latch mechanism 56 is disengaged by movement of the cover member 24 to its closed position illustrated in FIG. 4. For this purpose, an actuating device 62 is configured on the cover member 24 so as to engage against and push the resilient latch mechanism 56 out of the slot 50. In a relatively simple embodiment, the actuator 62 may comprise, for example, a relatively rigid plunger-like member 64 that is attached to an inside surface of a top portion of the cover member 24, as particularly illustrated in FIGS. 6 and 7. The plunger 64 is disposed at an angle so as to contact and move the head 60 against the biasing force of the resilient leg 58. As illustrated in FIG. 7, the head 60 is moved out of the slot 50 to such an extent that the block member 44 is released and then free to slide upwards within the slot 50 thereby relieving any compressive pressure exerted on the stack of sheets 12. The actuator or plunger 64 configured on the cover 24 is disposed and angled to such an extent that it does not interfere with movement of the block 44 to its relief position, as generally illustrated in FIG. 7.

It should be understood that the slot 50 along which the stop member 40 is slidably engaged may have a fairly limited longitudinal length. Once the stack of sheets 12 is depleted, the stop member 40 will slide longitudinally downwards to the extent allowed by the slot 50. The stop member 40 does not need to stay in contact with the top of the stack as the stack is depleted below the slot 50. The slot 50 has a longitudinal length such that the latch mechanism 56 is disposed intermediate of the slot 50. Upon release of the latch mechanism 56, the stop member 40 is free to travel further along the slot 50 to its relief position. Thus, the amount of "relief" is a function of the additional length of travel of the stop member 40 beyond the latch mechanism 56.

It should be appreciated that any number of physical configurations of a slidable stop member and resilient latch mechanism are within the scope and spirit of the invention. For example, the resilient latch mechanism may be a spring loaded button-like member that inhibits movement of a slidable stop member until the button is depressed by a member on the cover 24. Any number of engaging devices may be configured for this purpose.

It should thus be appreciated by those skilled in the art that various modifications and variations can be made to the embodiments described and illustrated herein without departing from the scope and spirit of the invention. It is intended that the invention include such modifications and variations as come within the scope of the appended claims and their equivalents.

What is claimed is:

1. A dispenser for dispensing stacked folded sheets, said dispenser comprising:

a housing configured to hold a stack of folded sheets in an internal storage space;

said housing further comprising a cover pivotally attached to said housing and movable between an open position wherein access is provided to said internal storage space for loading folded sheets, and a closed position wherein said cover defines a front panel of said dispenser;

at least one dispensing opening through which folded sheets are dispensed from said internal storage space; and an overfill prevention device configured within said housing, said overfill prevention comprising a stop member movably configured with a back wall of said housing and movable between a restricting position when said cover is in said open position, and a relief position when said cover is in said closed position;

a latch mechanism disposed in said housing in a position so as to latch said stop member in said restricting position when said cover is in said open position, wherein said back wall is stationary such that said cover is pivotable with respect to said back wall, and wherein said latch mechanism is pivotable through an opening defined in said back wall;

an actuator disposed on said cover in a position so as to engage and release said latch mechanism when said cover is in said closed position, said stop member then free to move towards said relief position whereby pressure in the stack of folded sheets is relieved;

said stop member comprising a longitudinally movable ledge extending generally transversely from said back wall such that the stack of folded sheets is placed in said internal storage space below said ledge;

a block member defining said ledge, said block member having a back side slidably engaged in a longitudinally extending slot defined in said back wall, and wherein said opening defined in said back wall is said slot;

said latch mechanism disposed along said slot at a position defining said restricting position, said latch mechanism preventing movement of said block within said slot until said latch mechanism is released by said cover;

said latch mechanism comprising a resiliently mounted latch extending generally transversely and biased into said slot, said latch movable out of said slot by engagement with said cover actuator; and wherein said latch comprises a resilient leg attached to said back wall and a hook-like head member, said leg disposed along said slot.

2. A dispenser for dispensing stacked folded sheets, said dispenser comprising:

a housing configured to hold a supply of folded sheets, said housing including a back wall and a bottom portion having at least one dispensing opening defined therein;

a cover pivotally mounted relative to said housing and movable between an open position wherein access is provided to said housing for loading stacked folded sheets, and a closed position wherein said cover is releasably engaged with said housing and defines a front panel of said dispenser, wherein said back wall is stationary such that said cover is pivotable with respect to said back wall;

a stop member defining a ledge that extends generally transversely from said back wall, said stop member slidable with a slot defined in said back wall between a restricting position when said cover is in said open position, and a relief position when said cover is in said closed position;

a resilient latch mechanism disposed along said slot in a position so as to latch said stop member in said restricting position when said cover is in said open position, wherein said latch mechanism is pivotable through said slot; and an actuator disposed on said cover in a position so as to engage and release said latch mechanism when said cover is in said closed position, said stop member then free to slide within said slot to said relief position whereby pressure in the stack of folded sheets is relieved upon closing said cover.

3. The dispenser as in claim 2, wherein said housing comprises an additional said dispensing opening and is configured as a dual dispenser for two supplies of folded sheets, said dispenser further comprising a said stop member, resilient latch, and actuator for each dispensing position.

4. A dispenser for dispensing stacked folded sheets, said dispenser comprising:

a housing configured to hold a supply of folded sheets, said housing including a back wall and a bottom portion having at least one dispensing opening defined therein;

a cover pivotally mounted relative to said housing and movable between an open position wherein access is provided to said housing for loading stacked folded sheets, and a closed position wherein said cover is releasably engaged with said housing and defines a front panel of said dispenser;

a stop member defining a ledge that extends generally transversely from said back wall, said stop member slidable with a slot defined in said back wall between a restricting position when said cover is in said open position, and a relief position when said cover is in said closed position;

a resilient latch mechanism disposed along said slot in a position so as to latch said stop member in said restricting position when said cover is in said open position; and an actuator disposed on said cover in a position so as to engage and release said latch mechanism when said cover is in said closed position, said stop member then free to slide within said slot to said relief position whereby pressure in the stack of folded sheets is relieved upon closing said cover, wherein said latch mechanism comprises a generally transversely extending head on a resilient leg member, said leg member disposed along said slot and said head biased into said slot so as to prevent movement of said stop member along said slot unless said cover is closed.

5. The dispenser as in claim 4, wherein said actuator on said cover comprises a generally transversely extending plunger member mounted at a top of said cover in a position so as to extend into said slot and engage said head, said plunger disposed at an angle so as to push said head into said slot a sufficient distance such that said head releases from said stop member without said plunger interfering with subsequent movement of said stop member along said slot to said release position.

* * * * *